US006071152A

United States Patent [19]

Achammer et al.

[11] Patent Number: 6,071,152

[45] Date of Patent: Jun. 6, 2000

[54] ELECTRICAL CONNECTOR WITH INSERTED TERMINALS

[75] Inventors: Daniel G. Achammer, Warrenville; Emanuel G. Banakis; David G. Mead, both of Naperville, all of Ill.

[73] Assignee: Molex Incorporated, Lisle, Ill.

[21] Appl. No.: 09/063,887

[22] Filed: Apr. 22, 1998

[51] Int. Cl.[7] ..... H01R 13/40

[52] U.S. Cl. ..... 439/733.1; 439/751; 439/873

[58] Field of Search ..... 439/733.1, 744, 439/746, 747, 750, 751, 752.5, 869, 871, 872, 873

[56] References Cited

U.S. PATENT DOCUMENTS

| | | | |
|---|---|---|---|
| 3,631,381 | 12/1971 | Pittman | 339/176 |
| 3,846,741 | 11/1974 | Kunkle et al. | 339/221 |
| 4,429,459 | 2/1984 | Lynch | 29/881 |
| 4,619,495 | 10/1986 | Sochor | 439/637 |
| 4,698,030 | 10/1987 | Ryll et al. | 439/752 |
| 4,762,507 | 8/1988 | Rudy, Jr. et al. | 439/595 |
| 5,263,882 | 11/1993 | Peterson | 439/733 |
| 5,586,915 | 12/1996 | Baker et al. | 439/733.1 |
| 5,609,502 | 3/1997 | Thumma | 439/747 |
| 5,702,257 | 12/1997 | Millhimes | 439/79 |
| 5,882,230 | 3/1999 | Bricaud et al. | 439/630 |

*Primary Examiner*—Paula Bradley
*Assistant Examiner*—Ross Gushi
*Attorney, Agent, or Firm*—Charles S. Cohen

[57] ABSTRACT

An electrical connector includes a dielectric housing having a plurality of terminal-receiving passages. A plurality of terminals are inserted into the passages in an insertion direction. The terminals have tool-engaging surfaces on opposite sides thereof, exposed opposite the insertion direction, for engagement by appropriate terminal-engaging tooling. The terminals have outwardly spaced, inwardly facing retention surfaces for engaging outwardly facing retention surfaces of the housing for establishing a press-fit to retain the terminals in the housing. Surrounding walls are not required to hold the terminals in the housing.

19 Claims, 3 Drawing Sheets

ELECTRICAL CONNECTOR WITH INSERTED TERMINALS

FIELD OF THE INVENTION

This invention generally relates to the art of electrical connectors and, particularly, to an electrical connector which has a plurality of terminals inserted into a housing to a given depth and retained therein.

BACKGROUND OF THE INVENTION

Generally, an electrical connector includes a dielectric housing mounting a plurality of terminals for interconnecting electrical devices. The terminals typically have contact portions or ends and terminating portions or ends. The contact portions engage complementary contacts of a mating connector, for instance. The terminating portions may be terminated to electrical conductors or to circuit traces on a printed circuit board, for instance. In the latter instance, the terminating portions may comprise solder tails for insertion into holes in the printed circuit board to connect the tails to circuit traces on the board and/or in the holes. Still further, the solder tails may comprise compliant tails for establishing a press-fit within the board holes.

Various problems often are encountered in designing circuit board mounted connectors of the character described above. For instance, the terminals preferably are inserted into the connector housing to a precise depth. If the terminals have compliant terminal tails creating an interference fit within the board holes, positive stops must be provided on the housing to limit the depth of insertion of the terminals. Absent such positive stops, the interference fit of the compliant tails in the board holes will force the terminals further into the housing than is desired.

Various other problems are encountered in designing such electrical connectors, particularly in retaining the terminals within the connector housing. Typically, some type of retention means is provided between the terminals and the housing to prevent the terminals from backing out of the housing after insertion. For instance, terminals often are inserted into terminal-receiving passages in the housing with an interference or press-fit to hold the terminals in the passages. Other means such as barbs also are used to actually skive into the walls of the passages to lock the terminals therewithin.

A problem in retaining terminals within housing passages by an interference or press-fit is that the housing must have adequate supporting walls to accommodate these insertion forces. With the ever-increasing miniaturization of electrical connectors accompanied by resulting high density terminal arrays, it often is difficult to provide adequate supporting walls within the dielectric connector housing to absorb the forces desired. The present invention is directed to solving this myriad of problems with a unique terminal/housing structure which not only provides adequate means on the terminals for engagement by insertion tooling, and stop means on the housing to limit the depth of insertion of the terminals, but the terminals are retained within the housing without an interference fit with surrounding walls of the housing.

SUMMARY OF THE INVENTION

An object, therefore, of the invention is to provide a new and improved electrical connector of the character described above.

In the exemplary embodiment of the invention, the electrical connector includes a dielectric housing having a plurality of terminal-receiving passages. A plurality of terminals are inserted into the passages in an insertion direction. Each of the terminals includes a contact portion or end and a terminating portion or end. At least one of the terminals includes a pair of L-shaped wings projecting from opposite sides of the terminal. Each L-shaped wing defines a first leg projecting outwardly of the terminal generally transverse to the insertion direction, and a second leg projecting from an outer end of the first leg generally in the insertion direction. The first legs have tool-engaging surfaces exposed opposite the insertion direction for engagement by appropriate terminal-engaging tooling. The second legs have inside retention surfaces spaced from and facing inwardly toward the terminal. The housing includes retention surfaces facing outwardly of the terminal for establishing a press-fit with the inside retention surfaces of the second legs of the L-shaped wings of the terminal. Therefore, establishing an interference or press-fit with surrounding walls of the housing is obviated.

As disclosed herein, the terminals preferably are stamped and formed from conductive sheet metal material. The terminating and contact portions of each terminal are offset from each other in a direction generally transverse to the insertion direction. The terminating portion of each terminal is coplanar with the tool-engaging surfaces in the insertion direction. The terminating portion comprises a compliant portion for press-fitting into a hole in a printed circuit board.

Finally, the first legs of the L-shaped wings of the terminals have stop surfaces facing in the insertion direction for engaging complementary stop shoulders on the housing to define the depth of insertion of the terminals. Preferably, the housing has the stop shoulders at different depths for different ones of the terminals depending on the desired depth of insertion of the terminals into the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
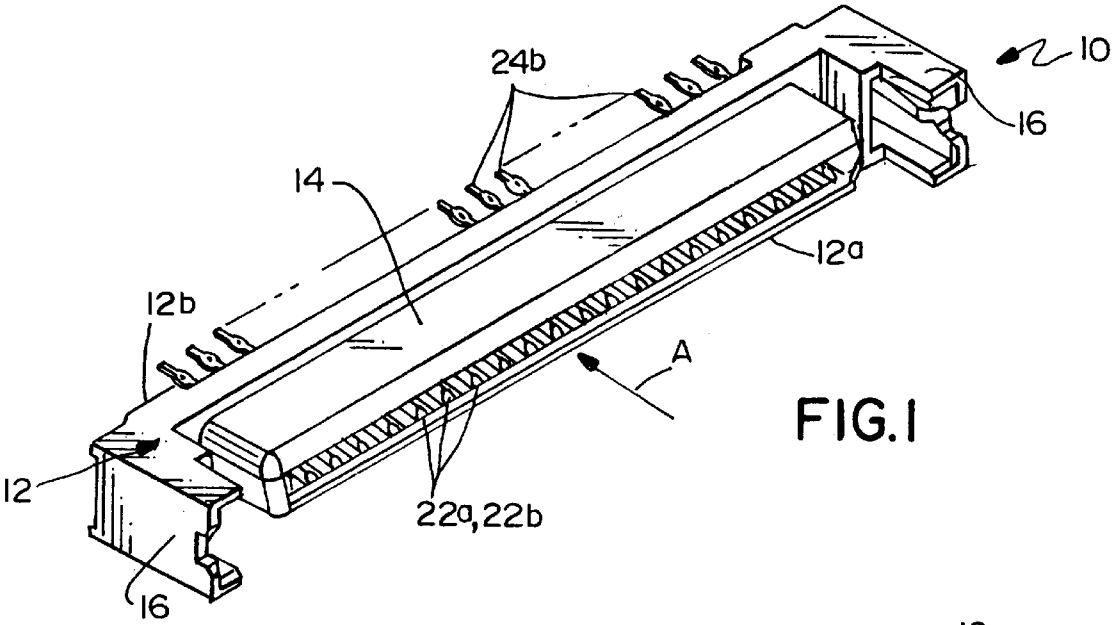
FIG. 1 is a perspective view of an electrical connector with which the invention is applicable.
Figure 2:
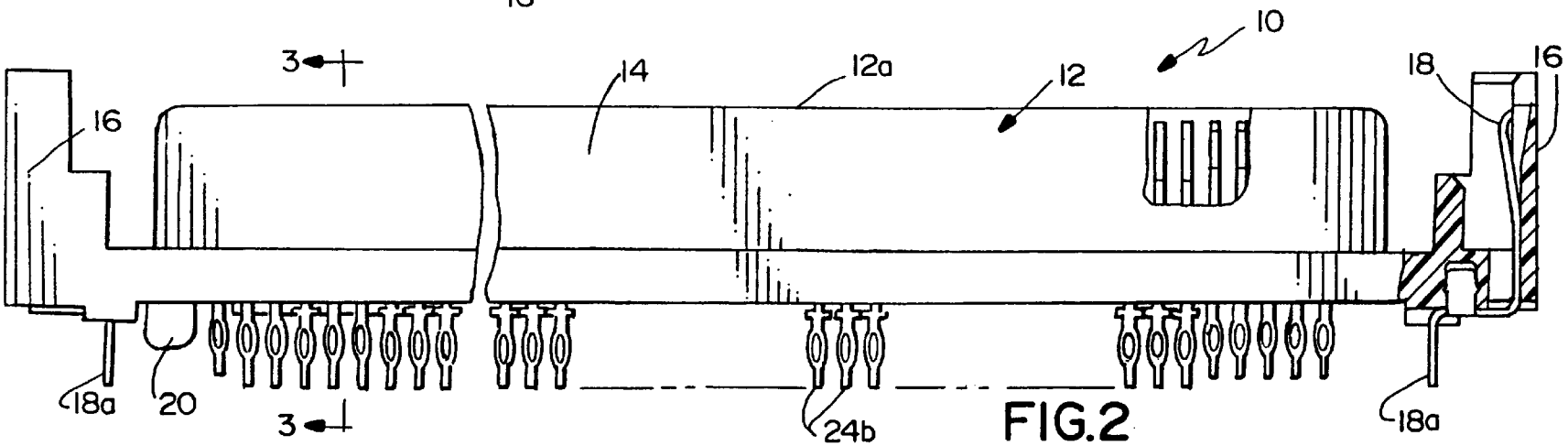
FIG. 2 is a fragmented elevational view of the connector.

Referring to the drawings in greater detail, and first to FIGS. 1 and 2, the invention is embodied in an electrical connector, generally designated 10, which includes an insulating or dielectric housing, generally designated 12. The housing is elongated and defines a mating face 12*a* and a terminating face 12*b*. A receptacle 14 projects forwardly of the housing to form mating face 12*a* and receives a plug portion of a complementary mating connector (not shown) inserted into the receptacle in the direction of arrow "A." A pair of side channels 16 of the housing guide the mating connector into mating position. A pair of metal ground contacts 18 (FIG. 2) may be disposed within channels 16, the ground contacts having projecting boardlock portions 18*a*. The housing also may include a polarizing peg 20 (FIG. 2) for insertion into an appropriate hole in a printed circuit board. The housing is a one-piece structure unitarily molded of dielectric material such as plastic or the like.

Figure 3:
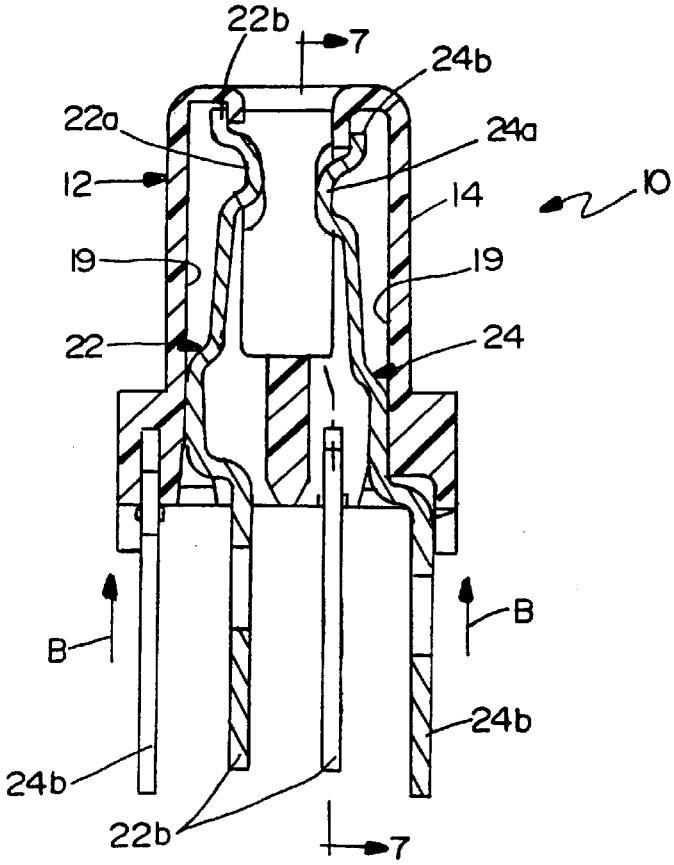
FIG. 3 is a vertical section taken generally along line 3—3 of FIGS. 2 and 6.
Figure 4:
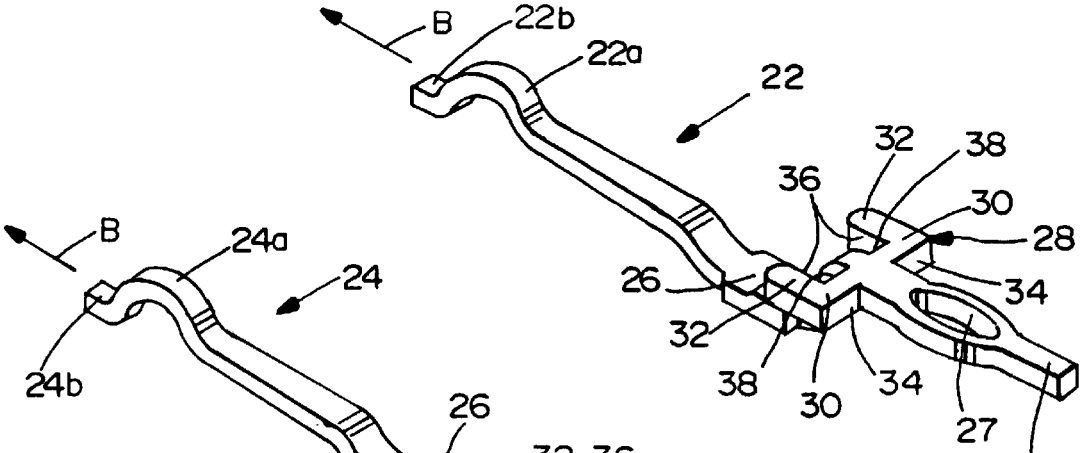
FIG. 4 is a perspective view of one of the terminals of the inner row of terminals in the connector.
Figure 5:
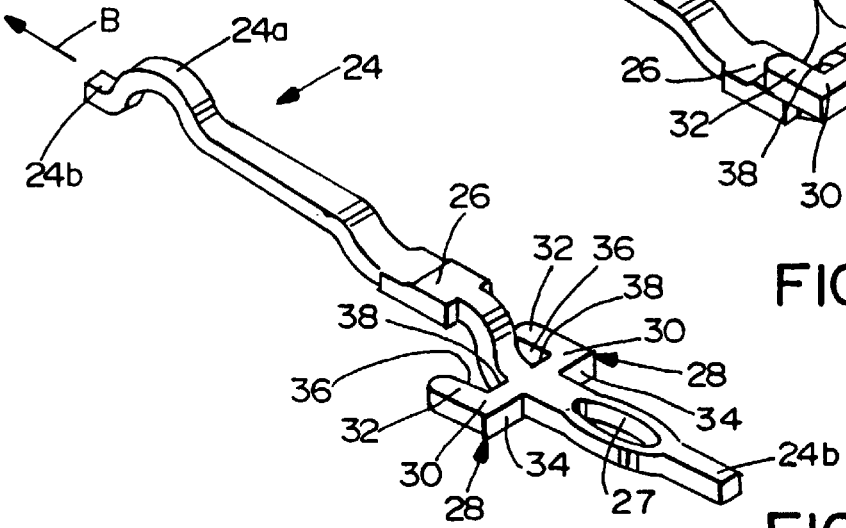
FIG. 5 is a perspective view of one of the terminals of the outer row of terminals in the connector.
Figure 6:
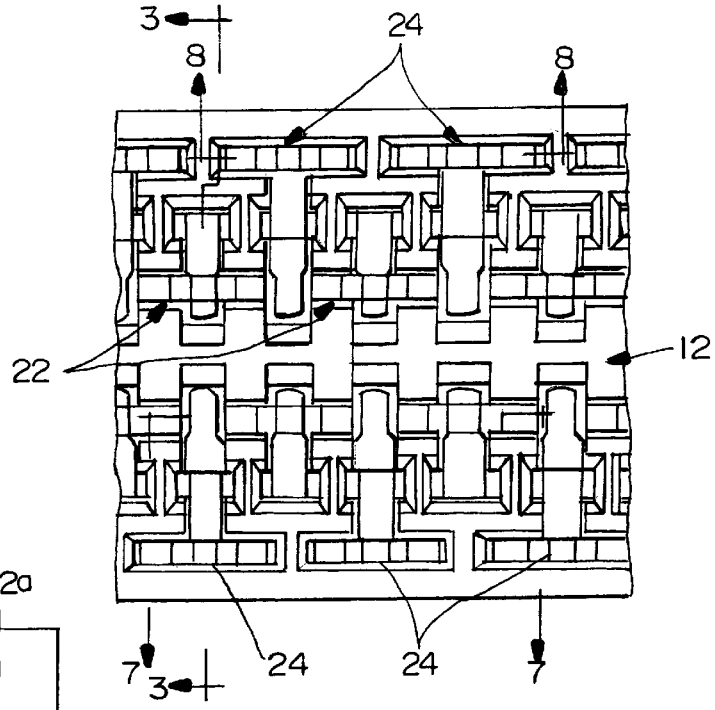
FIG. 6 is a fragmented bottom plan view of a section of the connector as looking toward the bottom of FIG. 2.

Referring to FIGS. 3–5 in conjunction with FIGS. 1 and 2, a plurality of terminals, generally designated 22 and 24, are mounted in two rows of terminal-receiving passages 19 along the length of connector housing 12. As seen in FIG. 3, the terminals are mounted in pairs, with one terminal 22 and one terminal 24 in each pair, along the length of the connector. Terminal 22 will be referred to herein as an "inner" terminal, and terminal 24 will be referred to herein as an "outer" terminal, because of the inner and outer disposition of their terminating portions or solder tails as will be described hereinafter. The inner and outer terminals alternate in each alternating pair lengthwise of the connector so that the two rows of pairs of terminals define four rows of terminal tails as seen in FIG. 3. The terminals are inserted into passages 19 in the direction of arrows "B."

As best seen in FIGS. 4 and 5, each of the inner and outer terminals 22 and 24, respectively, is elongated and includes a contact portion or end 22*a* and 24*a*, respectively, and a terminating portion or end 22*b* and 24*b*, respectively. The terminals include intermediate body portions 26. The terminals are stamped and formed of conductive sheet metal material. Terminating portions 22*b*,24*b* are offset from contact portions 22*a*,24*a* relative to insertion direction "B". Therefore, by alternating the pairs of terminals in opposite orientations lengthwise of housing 12, four rows of terminating portions are provided as seen in FIG. 3. The terminating portions define tail portions for the terminals for insertion into appropriate holes in a printed circuit board. The tails have holes 27 in enlarged portions of the tails to provide compliant tails which establish an interference fit within the board holes.

Still referring to FIGS. 4 and 5, each inner and outer terminal 22 and 24, respectively, includes a pair of L-shaped wings, generally designated 28, projecting from opposite sides of the terminal. Each L-shaped wing defines a first leg 30 projecting outwardly of the terminal, generally transverse to the insertion direction defined by arrows "B" (FIG. 3). Each L-shaped wing section 28 also defines a second leg 32 projecting from an outer end of first leg 30 generally in the insertion direction. The first legs 30 have tool-engaging surfaces 34 exposed opposite the insertion direction for engagement by appropriate terminal-engaging tooling. The second legs 32 have inside retention surfaces 36 spaced from and facing inwardly toward the respective terminal. Finally, first legs 30 have surfaces 38 which face in the insertion direction and define stop surfaces to determine the depth of insertion of the terminals, as seen hereinafter.

Figure 7:
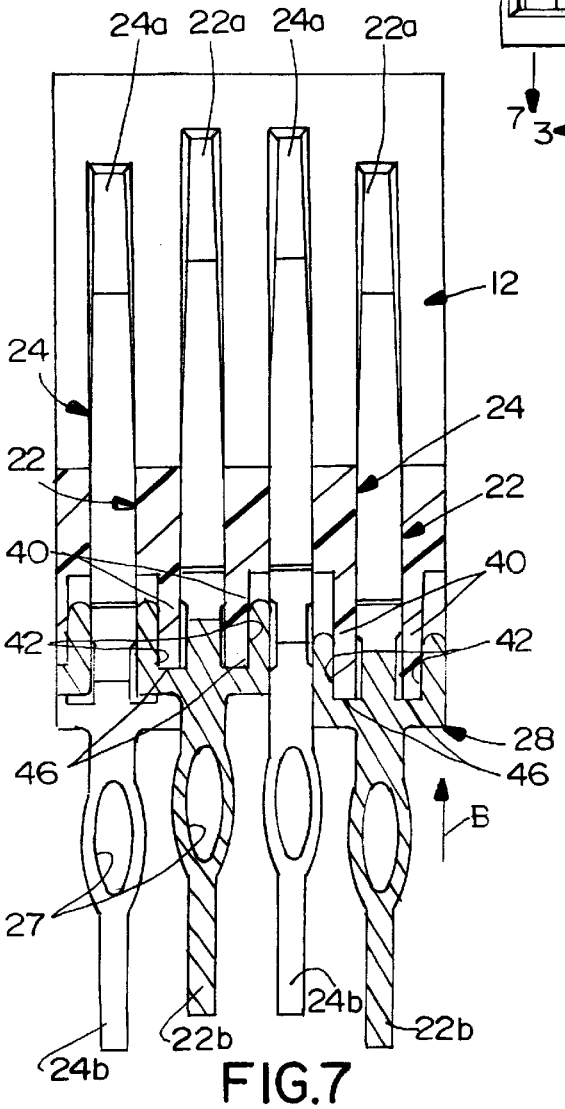
FIG. 7 is a section taken generally along line 7—7 of FIG. 6.

Referring to FIG. 7 in conjunction with FIGS. 4 and 5, dielectric housing 12 has a pair of interior retention walls 40 associated with each terminal. The retention walls engage inside legs 32 of the L-shaped wings 28 of inner terminals 22 when the terminals are inserted into the housing in the direction of arrows "B" (FIG. 7). Retention walls 40 have outwardly facing retention surfaces 42 which are positioned relative to inside legs 32 of L-shaped wings 28 to establish a press-fit with inside retention surfaces 36 (FIGS. 4 and 5) in the inner row of terminals. In other words, the spacing between the outwardly facing retention surfaces 42 of each pair of walls 40 is slightly greater than the spacing between inside retention surfaces 36 of the pair of legs 32 of the respective terminal so that an interference fit is established between the terminal and the housing to prevent the terminal from backing out of the housing opposite insertion direction "B." As such, the legs 32 will either skive into walls 40 or legs 32 will deflect outward as they engage the walls 40, or some combination of the two. It can be understood from this depiction that there are no walls required to surround terminals 22 in order to hold the terminals within the housing. In fact, it can be seen in FIG. 7 that there are no wall portions of the housing that even exist between legs 32 of the adjacent terminals. Therefore, the terminals can be positioned on a closer pitch than if surrounding walls were required to hold the terminals in the housing. Since L-shaped wings 28 must project outwardly of the terminals to provide tool-engaging surfaces 34, this "real estate" is uniquely used to provide retention means for the terminals.

Figure 8:
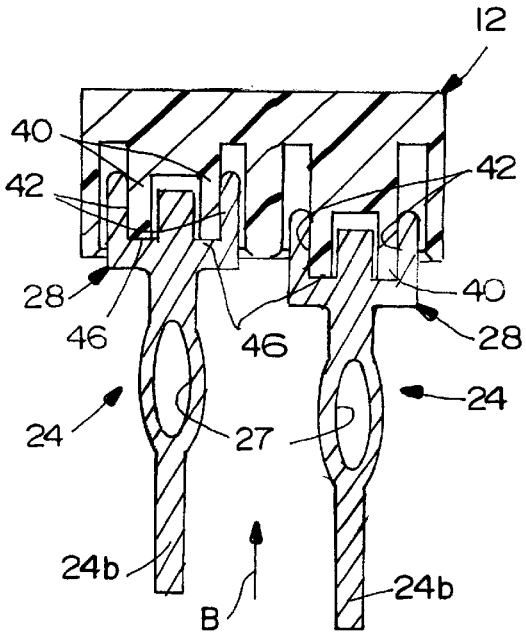
FIG. 8 is a section taken generally along line 8—8 of FIG. 6.

FIG. 8 shows a pair of terminals 24 in the outer row thereof. Although the housing is constructed to have wall portions 44 between the terminals, it can be seen that legs 32 of the terminals do not even engage these outside wall portions. Like terminals 22, terminals 24 are retained within the housing by an interference fit between inside retention surfaces 36 of the terminals and outside retention surfaces 42 of walls 40 of the housing. Therefore, it is not necessary for wall portions 44 to be of sufficient size and/or strength to hold the terminals within the housing. These wall portions do, however, provide additional rigidity to the housing.

Both FIGS. 7 and 8 show stop surfaces 38 (FIGS. 4 and 5) in engagement with stop shoulders 46 at the distal edges of walls 40 of the housing. The engagement of stop surfaces 38 of the terminals with stop shoulders 46 of the housing defines the depth of insertion of the terminals. It also can be seen in FIGS. 7 and 8 that stop shoulders 46 on the housing are at different depths for different ones of the terminals. This different positioning of the stop shoulders depends on the desired depth of insertion of the terminals into the housing. Therefore, if it is desired to have a "first-make-last-break" terminal arrangement, stop shoulders 46 are molded at different positions within the housing.

An additional feature of the present invention is the fact that the tips of the terminals 22*b*, 24*b* engage the plastic housing with a light force or preload. This is primarily for the purpose of ensuring true position of the contact portions 22*a*, 24*a* in the unlikely event that any of the terminals moves during the process of pressing the connector onto a printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

an elongated dielectric housing having a longitudinal axis and a plurality of terminal-receiving passages extending along said housing in a row;

a plurality of terminals inserted into the passages in an insertion direction to form a row of terminals, each of the terminals including a contact portion and a terminating portion, each of the terminals including a pair of L-shaped wings projecting from opposite sides thereof, each L-shaped wing defining a first leg projecting outwardly of the terminal generally transverse to said insertion direction and a second leg projecting from an outer end of the first leg generally in said insertion direction, each said first leg having a tool-engaging surface exposed opposite said insertion direction for engagement by appropriate terminal-engaging tooling, and each said second leg having an inside retention surface spaced from and facing inwardly toward the terminal; and said housing including a terminal retention area associated with each terminal-receiving passage, each said terminal retention area having a pair of spaced apart retention walls extending generally parallel to said insertion direction, the retention walls of each pair being positioned on opposite longitudinal sides of their respective terminal receiving passage, said retention walls further including retention surfaces facing outwardly of the terminals for establishing a press-fit with said inside retention surfaces of the terminal; and an additional recess in said housing located longitudinally between said pairs of spaced apart retention walls, said additional recess being dimensioned to provide that no portion of the housing is positioned between the second legs of adjacent terminals within the row of terminals.

2. The electrical connector of claim 1 wherein the contact ends of the terminals within each row are generally coplanar and the terminating portions of adjacent terminals are offset in opposite lateral directions relative to said plane of the contact ends.

3. The electrical connector of claim 1 wherein said housing includes a plurality of recesses for receiving said L-shaped wings, said recesses being arranged in two generally parallel, laterally spaced apart rows associated with each said row of terminal-receiving passages, the L-shaped wings of adjacent terminals within one of said rows of terminal-receiving passages being located in different ones of said two rows of recesses.

4. The electrical connector of claim 1 wherein said first legs of the L-shaped wings have stop surfaces facing in the insertion direction for engaging complementary stop shoulders on the housing to define the depth of insertion of the terminal.

5. The electrical connector of claim 4 wherein said housing has said stop shoulders at different depths for different ones of said terminals depending on the desired depth of insertion of the terminals into the housing.

6. The electrical connector of claim 1 wherein said at least one terminal is stamped and formed from conductive sheet metal material.

7. The electrical connector of claim 6 wherein said terminating and contact portions of the terminal are offset from each other in a direction generally transverse to said insertion direction.

8. The electrical connector of claim 6 wherein said terminating portion of the terminal is coplanar with said tool-engaging surfaces in the insertion direction.

9. The electrical connector of claim 8 wherein said terminating portion of the terminal comprises a compliant portion for press-fitting into a hole in a printed circuit board.

10. An electrical connector, comprising:

an elongated dielectric housing having a longitudinal axis and a plurality of terminal-receiving passages, said passages being arranged in two generally parallel, laterally spaced apart rows;

a plurality of terminals inserted into the passages in an insertion direction to form two generally parallel, laterally spaced apart rows of terminals, each of the terminals being elongated and stamped and formed of conductive sheet metal material and including a contact end and a terminating end, the terminating end and contact end of each terminal being offset from each other generally transverse to said insertion direction, the contact ends of the terminals within each row being generally coplanar and the terminating portions of adjacent terminals being offset in opposite directions relative to said plane of the contact ends, the terminating ends of the terminals comprising compliant portions for press-fitting into a hole in a printed circuit board, the contact ends of the terminals comprising tips that engage a portion of the housing to create a preload on the housing, each said terminal including a pair of L-shaped wings projecting from opposite sides thereof, each L-shaped wing defining a first leg projecting outwardly of the terminal generally transverse to said insertion direction and a second leg projecting from an outer end of the first leg generally in said insertion direction, said first legs having tool-engaging surfaces exposed opposite said insertion direction for engagement by appropriate terminal-engaging tooling, and said second legs having inside retention surfaces spaced from and facing inwardly toward the terminal, the terminating portion of each said terminal being coplanar with the tool-engaging surfaces thereof in the insertion direction; and said housing including retention surfaces facing outwardly of each said terminal for engaging said inside retention surfaces of each respective terminal.

11. The electrical connector of claim 10 wherein the contact ends of the terminals within each row are generally coplanar and the terminating portions of adjacent terminals are offset in opposite lateral directions relative to said plane of the contact ends.

12. The electrical connector of claim 10 wherein said housing includes a plurality of recesses for receiving said L-shaped wings, said recesses being arranged in two generally parallel, laterally spaced apart rows associated with each said row of terminal-receiving passages, the L-shaped wings of adjacent terminals within one of said rows of terminal-receiving passages being located in different ones of said two rows of recesses.

13. The electrical connector of claim 10 wherein said first legs of the L-shaped wings have stop surfaces facing in the insertion direction for engaging complementary stop shoulders on the housing to define the depth of insertion of the terminal.

14. The electrical connector of claim 13 wherein said housing has said stop shoulders at different depths for different ones of said terminals depending on the desired depth of insertion of the terminals into the housing.

15. An electrical connector, comprising:

an elongated dielectric housing having a longitudinal axis and a plurality of terminal-receiving passages, said passages being arranged in two generally parallel, laterally spaced apart rows;

a plurality of terminals inserted into the passages in an insertion direction to form two generally parallel, spaced apart rows of terminals generally parallel to the longitudinal axis, each of the terminals being elongated and stamped and formed of conductive sheet metal material and including a contact end and a terminating end, the terminating end and contact end of each terminal being offset from each other generally transverse to said insertion direction, the terminating ends of the terminals comprising compliant portions for press-fitting into a hole in a printed circuit board, the contact ends of the terminals comprising tips that engage a portion of the housing to create a preload on the housing, each said terminal including at least one L-shaped wing projecting therefrom, each L-shaped wing defining a first leg projecting outwardly of the terminal generally transverse to said insertion direction and a second leg projecting from an outer end of the first leg generally in said insertion direction, said first legs having tool-engaging surfaces exposed opposite said insertion direction for engagement by appropriate terminal-engaging tooling, and said second legs having inside retention surfaces spaced from and facing inwardly toward respective terminals, the terminating portion of each said terminal being coplanar with the tool-engaging surfaces thereof in the insertion direction; and said housing including a terminal retention area associated with each terminal-receiving passage, each said terminal retention area having a pair of spaced apart retention walls extending generally parallel to said insertion direction, the retention walls of each pair being positioned on opposite longitudinal sides of their respective terminal receiving passage, said retention walls further including retention surfaces facing outwardly of each said terminal for engaging said inside retention surface of each respective terminal; and an additional recess in said housing located longitudinally between said pairs of spaced apart retention walls, said additional recess being dimensioned to provide that no portion of the housing is positioned between the second legs of adjacent terminals within the row of terminals.

16. The electrical connector of claim 15 wherein the contact ends of the terminals within each row are generally coplanar and the terminating portions of adjacent terminals are offset in opposite lateral directions relative to said plane of the contact ends.

17. The electrical connector of claim 15 wherein said housing includes a plurality of recesses for receiving said L-shaped wings, said recesses being arranged in two generally parallel, laterally spaced apart rows associated with each said row of terminal-receiving passages, the L-shaped wing of adjacent terminals within one of said rows of terminal-receiving passages being located in different ones of said two rows of recesses.

18. The electrical connector of claim 15 wherein said first leg of each L-shaped wing has stop surface facing in the insertion direction for engaging a complementary stop shoulder on the housing to define the depth of insertion of the terminal.

19. The electrical connector of claim 18 wherein said housing has said stop shoulders at different depths for different ones of said terminals depending on the desired depth of insertion of the terminals into the housing.

* * * * *